US007938165B2

(12) United States Patent
Lequeu et al.

(10) Patent No.: US 7,938,165 B2
(45) Date of Patent: May 10, 2011

(54) MANUFACTURING PROCESS FOR SEMI-FINISHED PRODUCTS CONTAINING TWO ALUMINUM-BASED ALLOYS

(75) Inventors: Philippe Lequeu, Veyre-Monton (FR); Benoit Commet, Colmar (FR); Armelle Danielou, Les Echelles (FR); David Dumont, Gardanne (FR); Olivier Ribaud, Renage (FR)

(73) Assignee: Alcan Rhenalu, Paris (FR)

( * ) Notice: Subject to any disclaimer, the term of this patent is extended or adjusted under 35 U.S.C. 154(b) by 921 days.

(21) Appl. No.: 11/633,640

(22) Filed: Dec. 5, 2006

(65) Prior Publication Data

US 2007/0259200 A1 Nov. 8, 2007

Related U.S. Application Data

(60) Provisional application No. 60/764,370, filed on Feb. 2, 2006.

(30) Foreign Application Priority Data

Dec. 16, 2005 (FR) ..... 05 12809

(51) Int. Cl.
*B22D 11/00* (2006.01)
*B22D 19/16* (2006.01)

(52) U.S. Cl. ..... 164/461; 164/95; 164/96

(58) Field of Classification Search ..... 164/91, 164/94, 95, 96, 461
See application file for complete search history.

(56) References Cited

U.S. PATENT DOCUMENTS

| | | | | |
|---|---|---|---|---|
| 3,353,934 | A | 11/1967 | Robinson | |
| 3,421,569 | A | 1/1969 | Neumann | |
| 4,567,936 | A * | 2/1986 | Binczewski | 164/453 |
| 5,213,639 | A | 5/1993 | Colvin et al. | |
| 5,547,524 | A | 8/1996 | Sainfort et al. | |
| 6,450,237 | B1 * | 9/2002 | Meyer et al. | 164/135 |
| 6,528,183 | B2 | 3/2003 | Dif et al. | |
| 6,705,384 | B2 * | 3/2004 | Kilmer et al. | 164/461 |

FOREIGN PATENT DOCUMENTS

| | | | |
|---|---|---|---|
| DE | 844806 | C | 7/1952 |
| DE | 4420697 | A1 | 12/1995 |
| FR | 2868084 | A1 | 9/2005 |
| GB | 1174764 | A | 12/1969 |
| JP | 48-5411 | | 2/1973 |
| JP | 58-32543 | * | 2/1983 |
| JP | 58-32543 | A * | 2/1983 |
| WO | 2004/112992 | A3 | 6/2004 |
| WO | 2005/063422 | | 7/2005 |
| WO | WO2005/063422 | * | 7/2005 |

* cited by examiner

*Primary Examiner* — Kevin P Kerns
(74) *Attorney, Agent, or Firm* — Dennison, Schultz & MacDonald

(57) ABSTRACT

A vertical casting process for an intermediate product, including the steps of (a) preparation of at least two aluminum based alloys, particularly a first alloy with composition P and a second alloy with composition T, (b) casting of the first alloy with composition P to a required height $H_P$, and (c) casting of an additional required height $H_T$ of the alloy with composition T. The object of this invention is the manufacture of monolithic structural elements with working properties that are variable in at least one direction, and particularly bi-functional or multi-functional structural elements capable of performing at least two functions that are traditionally performed by two different parts.

17 Claims, 7 Drawing Sheets

MANUFACTURING PROCESS FOR SEMI-FINISHED PRODUCTS CONTAINING TWO ALUMINUM-BASED ALLOYS

This application claims the benefit of U.S. Provisional Application No. 60/764,370 filed Feb. 2, 2006, which is incorporated herein by reference.

BACKGROUND OF THE INVENTION

1. Field of the Invention

The invention relates to a new manufacturing process for aluminum-based structural elements containing at least two different alloys, by casting a plate or billet comprising at least two spatially separate alloys, followed by one or more hot transformation steps by rolling, extrusion or forging, and possibly one or several cold transformation steps, and intermediate and/or final heat treatments. The invention is particularly useful for manufacturing structural elements for aeronautical construction.

2. Description of Related Art

Parts with spatially variable mechanical characteristics are very attractive for mechanical construction. Traditionally, they are made by assembling two parts with different properties, but they are essentially homogeneous inside each part. The assembly can be mechanical (for example by bolting or riveting), or by gluing or any appropriate welding technique. Thus, bi-functional or multi-functional structural parts or elements can be obtained. This bi-functionalization or multi-functionalization may depend on the shape of assembled parts (which is not the meaning used herein) or may be related to their mechanical properties, particularly when two parts made of different alloys are assembled together. For example, transition joints are used in shipbuilding (see C. Vargel, Corrosion de l'aluminum [Corrosion of aluminum], Paris, 1998, Dunod, page 136), that are structural elements normally assembled by explosion welding starting from a steel part and an aluminum part. The steel side acts as a base onto which other steel parts are fixed, and the aluminum side acts as a base onto which other aluminum parts are fixed. Therefore these transition joints are bi-functional structural elements that avoid galvanic corrosion that will inevitably be set up in a damp environment between two dissimilar metals assembled traditionally.

Examples of multi-functional parts essentially made of aluminum arise for protection against corrosion and welding. Cladded plates can comprise a core protected on at least one side by an alloy skin with better resistance to corrosion and/or that is more easily meltable, either to protect the core against corrosion or to make it easier to weld to another part. Cladded plates are made by taking a preferably scalped alloy plate with a first composition (called the core alloy), and placing a thinner second and preferably scalped rolling ingot or a rolled plate (called the cladding alloy) onto the first plate. The cladded plate is then hot rolled to obtain a cladded strip, the hot rolling operation assuring a strong metallurgical bond between the two alloys. Cladded plates are monolithic parts, in the sense of the definition given below. They can be used in aeronautical construction, for example as a fuselage skin (for example, see U.S. Pat. No. 5,213,639 (Aluminum Company of America) or patent EP 1 170 118 (Pechiney Rhenalu). The cladding process can be used to fabricate large parts, but the chemical composition is variable through the thickness rather than over the length or width of the part. Thus, functionalization is fairly limited: the function of cladding is either protection against corrosion, or weldability.

In another approach to manufacturing of a monolithic bi-functional part, a different artificial aging treatment is applied to each end of a long product made of a single aluminum based alloy. Patent EP 0 630 986 (Pechiney Rhenalu) describes a process for manufacturing structurally hardened aluminum alloy sheets with a continuous variation of usage properties along a principal direction (length, width, thickness) of the product, in which final artificial aging is performed in a furnace with a special structure comprising a hot chamber and a cold chamber connected together through a heat pump. This process has been used to obtain small parts made of 7010 alloy about a meter long, in which one end is in the T651 temper and the other end is in the T7451 temper, by an isochronous artificial aging treatment. This process has never been developed industrially because it is difficult to control in a manner compatible with quality requirements in the aeronautical construction domain; these industrial difficulties increase with the size of the parts. Furthermore, if only one part made of a single alloy is used, the amplitude of the variation of mechanical properties along the length of the part is fairly limited. A significant improvement in this process is described in Application FR 2 868 084, but once again, the chemical composition of the alloy cannot be modified with this process.

A large variation in mechanical properties can be expected if two different aluminum alloys are used.

In the field of cast alloys, the manufacture of monolithic parts comprising several alloys is known in the art. WO 2005/063422 describes a process in which a semi-solid casting material made from unmixed stratified portions of alloys with sufficiently different solidification intervals is introduced into a permanent mold so as to essentially fill the same, and letting the casting material solidify therein.

Applicants are not aware of any industrially made monolithic worked parts comprising two alloys spatially separate from each other, made using a process other then cladding by hot rolling. The concept of starting from as-cast parts (for example extrusion billets, rolling ingots) comprising two spatially separated alloys is not new. A distinction between several approaches is made.

A first approach uses one or several fixed or mobile partitions. U.S. Pat. No. 3,353,934 (Reynolds) describes vertical casting of ingots or a billet with a vertical fixed partition, the partition running along the length of the slab. This fixed partition is made of marinite, stainless steel or graphite. The patent describes casting of alloy pairs 7075/6063, 7075/5052 and 7075/5083.

JP 48-005411 (Sumitomo) describes another vertical partitioning method applied to cast slabs. Another embodiment of casting with a vertical partition is described in patent application DE 44 20 697 (Institut für Verformungskunde and Hüttenmaschinen). U.S. Pat. No. 6,705,384 (Alcoa, Inc.) describes the use of one or more partitions in the form of a thin or thick aluminum plate that remains incorporated in the cast slab or billet.

Casting with partition has also been adapted to continuous casting between strips. Patents GB 1 174 764 and FR 1 505 826 (Glacier) describe the use of a mobile partition applied to casting between strips for casting of Al+6% Sn/AS5G alloy pairs.

A second approach uses the concept of an internal ingot mold; a first alloy is solidified in an internal ingot mold, and the solid shell thus formed acts as a mold for the second alloy. This concept is described in patent DE 844 806 (Wieland Werke). A metal tube or a hollow billet can also be used as an external shell in which a liquid alloy is cast as described in patent FR 1 516 456 (Kennecott Copper Corporation). This principle has been adapted to vertical continuous casting of cladded slabs in U.S. Pat. No. 4,567,936 (Kaiser). Patent application WO 2004/112992 (Alcan) describes several methods of forming rolling ingots comprising two alloys by semi-continuous vertical casting, using vertical separators. This process is particularly adapted for the fabrication of cladded rolling ingots.

All these processes according to the state of the art result in long cast products that contain two different alloys separated by partitions or interfaces parallel to the direction of casting.

SUMMARY OF THE INVENTION

This invention proposes a new approach to fabrication of monolithic worked structural elements that have working properties that are variable in at least one direction different from the thickness direction, and particularly bi-functional or multi-functional worked structural elements capable of performing at least two functions that are traditionally performed by two different parts.

To achieve this and other objects, the invention is directed to a vertical casting process for an intermediate product with final height in the casting direction $H_F$, comprising the following steps:

(a) preparing of at least two aluminum based alloys, particularly a first alloy with composition P and a second alloy with composition T, (b) casting the first alloy with composition P to a required height $H_P$, and (c) casting an additional required height $H_T$ of the second alloy with composition T so as to reach a casting height of $H_P+H_T$ that is less than or equal to $H_F$.

Alloy preparations during step (a) are not necessarily concomitant. The preparation step (a) and the casting steps (b) and (c) are not necessarily successive, and particularly the preparation of the second alloy or any other additional alloy in step a) may be concomitant with one of the casting steps. In one advantageous embodiment of the invention, steps (b) and (c) are done with no interruption to the liquid metal flow. In this process, alloys may be prepared in different manners. For example, (i) aluminum based alloys may be prepared independently, or (ii) alloys with a composition different from P may be prepared from the first alloy during casting by adding the necessary quantities of elements to the first alloy to obtain the composition of the alloys with a composition different from P, or (iii) at least two aluminum based alloys may be prepared during casting starting from an aluminum based alloy with composition B, by adding necessary quantities of elements to alloy with composition B to obtain the compositions of the at least two aluminum based alloys P and T.

Another object of the invention is a first intermediate solid product which is to be rolled, extruded or forged, obtainable by the vertical casting process defined above. This product comprises at least one alloying element with a concentration gradient in the casting direction that is usually the direction of its height (i.e. its largest dimension). For example, this intermediate product may be a slab or a billet.

Another object of the invention is a process for fabrication of a metal plate, an extruded section or a forged product from a slab or a billet produced according to the vertical casting process defined above.

Yet another object of the invention is a second intermediate solid product such as a plate, an extruded section or a forged product obtainable by the process described above.

Yet another object of this invention is a structural element obtainable from the second intermediate product defined above. This structural element may be bi-functional or multi-functional.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention. In the drawings.

DETAILED DESCRIPTION OF THE INVENTION

Figure 1:
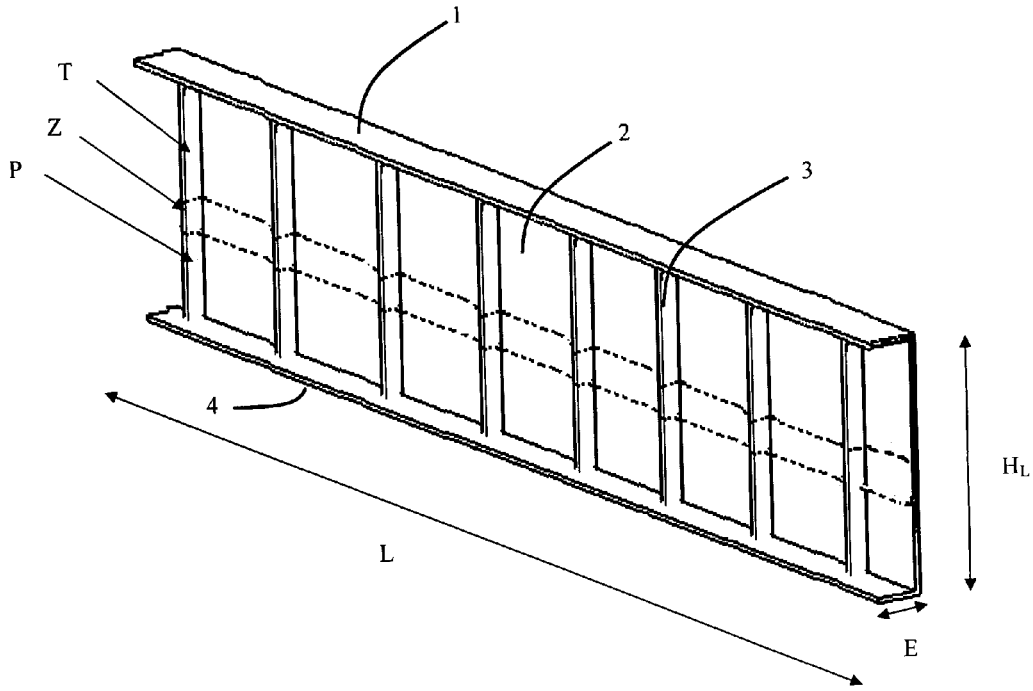
FIG. 1 diagrammatically shows a spar according to the invention.

Unless mentioned otherwise, all information about the chemical composition of alloys is expressed as a percent by weight. Consequently, in a mathematical expression, "0.4 Zn" means 0.4 times the zinc content, expressed as a percent by weight; this is applicable to other chemical elements. The designation of alloys follows the Aluminum Association rules known to a person skilled in the art. Metallurgical tempers are defined in European standard EN 515. The chemical composition of normalized aluminum alloys is defined in various sources including in standard EN 573-3. Unless mentioned otherwise, the static mechanical characteristics, in other words the ultimate tensile strength UTS or $R_m$, the tensile yield stress TYS or $R_{p0,2}$, and the elongation at rupture A %, are determined by a tensile test according to standard EN 10002-1, the location from which the test pieces are taken and their direction being defined in standards EN 485-1 (rolled products) or EN 755-1 (extruded products). The toughness KIC is measured according to standard ASTM E 399.

Unless mentioned otherwise, the definitions in European standard EN 12258-1 are applicable. The term "plate" is used in this description for all thicknesses of rolled products.

The term "machining" includes any material removal process such as turning, milling, drilling, reaming, tapping, spark machining, grinding, polishing.

As used herein, "casting installation" is used to refer to any device used to transform metals in any form whatsoever into a semi-finished product, passing through the liquid phase. A casting installation may include one or several furnaces necessary for melting metals or for keeping metals at a constant temperature, one or several furnaces for performing liquid metal preparation and composition adjustment operations, one or several tanks (or "ladles") that will perform a treatment to eliminate impurities dissolved or suspended in the liquid metal, this treatment possibly including filtering the liquid metal on a filter medium and/or adding a so-called "treatment" gas into the bath that can be inert or reactive, a device for solidification of the liquid metal (or "casting machine") comprising at least the following devices: a mold (or "ingot mold"), at least one liquid metal feed device (or "nozzle"), these different devices being connected together by gutters called "transfer trough" through which the liquid metal will be transported.

As used herein, a "structural element" of a mechanical construction is a mechanical part that, if it fails, could endanger the construction, its users or others.

For an aircraft, these structural elements comprise in particular the elements that form the fuselage (such as the fuselage skin, stiffeners or fuselage stringers, bulkheads, circumferential frames, wings, for example wing skin, stringers or stiffeners, ribs and spars) and the tail fin composed particularly of horizontal or vertical stabilizers, and floor beams, seat tracks and doors.

As further used herein, the term "monolithic structural element" or "monolithic part" refers to a structural element or a part that was obtained usually by machining a single-piece rolled, extruded, forged or cast partly finished product with no assembly such as riveting, welding, gluing.

The term "bi-functional or multi-functional structural element" refers mainly to functions conferred by the metallurgical and/or mechanical characteristics of the product, and not by its geometric shape.

According to the invention, a product is obtained by rolling, extruding or forging of a rolling ingot or a billet with a composition that is variable along the casting direction and for which the composition at the bottom is advantageously different from the composition at the top. The term "bottom" refers to the part cast first and the term "top" refers to the part cast last, in other words the parts at the bottom and top respectively, during a vertical casting. The vertical casting process for a part with a final height $H_F$ according to the invention comprises preparing and casting an aluminum based alloy with a first composition P up to a required height $H_P$, casting an additional required height $H_T$ of the second alloy so as to reach a casting height $H_P+H_T$ less than or equal to $H_F$, and optionally casting other aluminum based alloys or the alloy P up to the final height $H_F$. In one preferred embodiment, the liquid metal flow is not interrupted when changing from pouring the alloy with first composition P to pouring the alloy with second composition T, and advantageously when changing from pouring the alloy with composition T to pouring other alloys.

This vertical casting process generates solid intermediate products which are to be rolled, extruded or forged, comprising at least two alloys spatially separated along the casting direction. For solid intermediate products of the invention there is a concentration gradient for at least one alloying element along the casting direction.

This process vertical casting process usually generates between two successive alloys a "transition zone" Z with an intermediate composition between two successively cast alloys. Control of this transition zone between the alloys is important. In one preferred embodiment, the shortest possible transition zone is made, in other words the most sudden possible transition. But for some applications, a wider zone could also be envisaged by controlling the concentration gradients so as to guarantee repeatability from one casting operation to the next. To obtain a sudden transition between alloys, it is preferable to make the transition such that the mix between successive alloys is made in a part of the casting installation with a low volume and close to the casting machine. In order to obtain a sudden transition it is also possible to prepare alloy T from alloy P by making the necessary additions in a treatment, ladle. Typically, this transition can be made in a transfer trough by making a dam. If the transition is made in a part of the installation with a high volume such as a liquid metal treatment ladle for degassing or filtering, or upstream from such a part of the installation, the transition obtained will be wider since the two successive alloys can mix in larger proportions. In one preferred embodiment of the invention aimed at obtaining a short transition zone, the transition between alloys is made in a transfer trough or in a low volume liquid metal treatment ladle.

Figure 3:
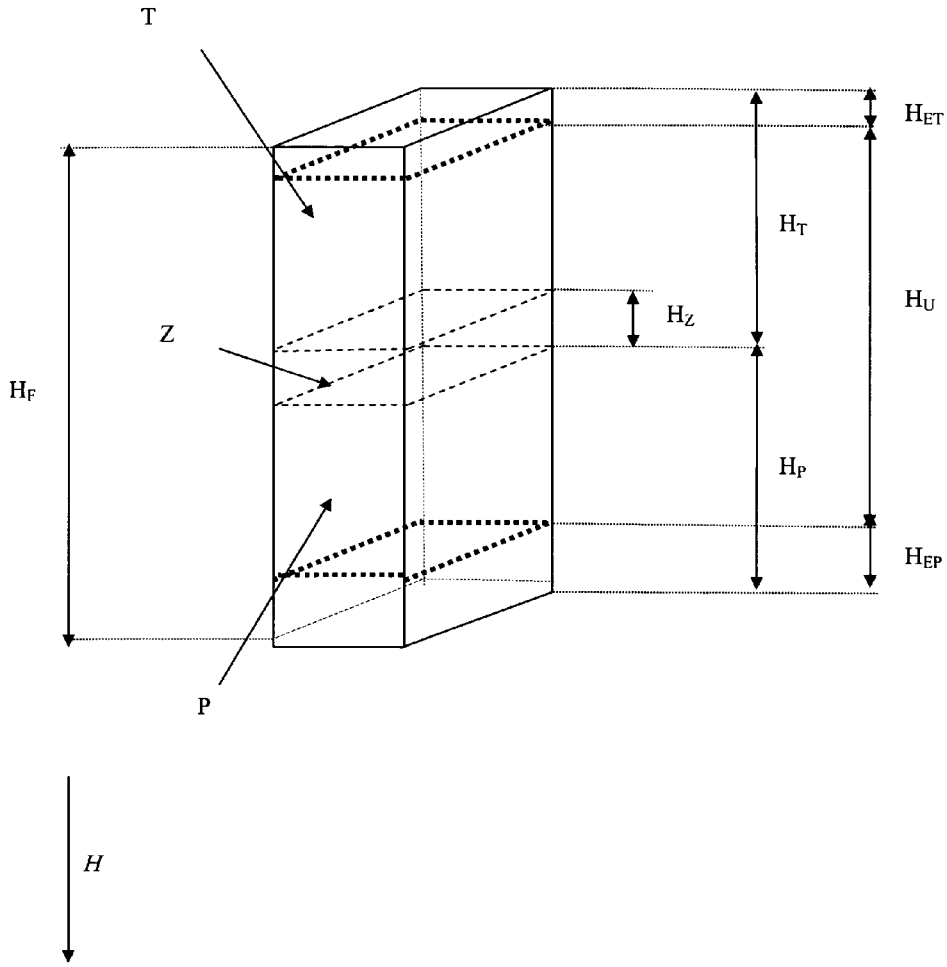
FIG. 3 diagrammatically shows a rolling ingot according to the invention, from which the thick plate according to the invention can be produced.

The casting process of the invention can be used according to several different embodiments that are distinguished by the manner in which the alloys are prepared and in how the transition between alloys is made. FIG. 3 shows an example of a slab cast according to the invention, in which the casting direction defines the direction of the height H of the slab. The total height of the slab is $H_F$. The normal practice is to saw ("crop") the ends of the slab after casting over a height of $H_{EP}$ at the bottom and $H_{ET}$ at the top so as to eliminate the parts corresponding to the start and end of the cast form that do not have the required quality for further transformation. Therefore the useful length $H_U$ of the cast form, typically a slab or a billet, is equal to $H_F-(H_{EP}+H_{ET})$. In advantageous embodiments, the height $H_P$ is greater than the height of the part of the slab or billet cropped at the bottom $H_{EP}$. The height $H_P$ depends on the intended application, however, and in the framework of the invention, the height $H_P$ is usually more than $H_{EP}+H_U/4$ and sometimes more than $H_{EP}+H_U/2$. The height of the transition zone is $H_Z$. In the example shown in FIG. 3, two alloys were cast and therefore the relation $H_F=H_P+H_T$ is obtained.

In a first embodiment, at least two aluminum based alloys (in this case referred to as "bottom alloy" or "alloy P" and "top alloy" or "alloy T") are prepared independently, for example in at least two separate furnaces. The first step is to cast the bottom alloy by pouring the liquid metal from the first furnace into the transfer trough. When the required metal height $H_P$ is reached in the casting machine, the metal flow from the first furnace is cut off, and replaced by a flow from the second furnace. This changeover from one furnace to the other is preferably made without interrupting the liquid metal flow in the transfer trough that empties into the casting machine. Thus, an additional height $H_T$ of the alloy with composition T is cast to reach a casting height $H_P+H_T$ less than or equal to $H_F$. In one advantageous embodiment of the invention, the sum $H_P+H_T$ is equal to $H_F$. Optionally, more complex slabs or billets can be made by casting other aluminum based alloys, such as a third alloy starting from a third furnace and a fourth alloy starting from a fourth furnace, or by casting alloy P from the first furnace up to the final height $H_F$, with composition sequences such as P/T/P, P/T/[third alloy] or P/T/[third alloy]/[fourth alloy]. This embodiment is suitable for all alloy combinations, either for casting alloys from the same family or for casting alloys from different families such as, for example a 2XXX alloy and a 7XXX alloy.

In a second embodiment, the bottom alloy is cast up to the required height $H_P$, and at least one alloying element with a higher content in alloy T than in alloy P is added at the required moment in the form of a wire or any other appropriate form. Thus, an additional height $H_T$ of the alloy with composition T is cast to reach a casting height $H_P+H_T$ less than or equal to $H_F$. Thus for example, if alloy P is an Al–Zn 5.0–Cu 1.5–Mg 1.5 type alloy and alloy T is an Al–Zn 5.0–Cu 1.5–Mg 2.5 type alloy, a liquid alloy is generated with a composition corresponding to the composition of alloy P, and magnesium wire is added into the liquid metal at the required time into an appropriate part of the casting installation such as the casting furnace, a transfer trough or a treatment ladle.

In a third embodiment of the invention, a base alloy is cast, into which the quantities of alloy elements necessary to obtain the composition P, and then the composition T, and then possibly other compositions, are added. The quantity of alloy elements added per unit mass of cast metal is modified when the required height $H_P$ is reached, and casting is stopped when the required final height $H_F$ is reached. For example, zinc wire, magnesium wire and copper wire can be used that are added to pure aluminum or aluminum that could contain other elements for which the target concentration is approximately the same for alloy P, alloy T and the other alloys, if any. Another alloy wire could also be used, for example based on aluminum. This wire is typically procured in the form of coils and added to the liquid metal through an unwinder in an appropriate part of the installation. In one advantageous embodiment of the invention, this wire is procured in a transfer trough on the output side of treatment ladles, so as to obtain a sudden transition between alloys when the quantity of wire supplied per unit time is changed. In another example of this third embodiment, alloy P is obtained by adding to the base alloy the necessary alloying elements in a treatment ladle and alloy T is identical to the base alloy.

The first embodiment has the disadvantage that it requires at least two casting furnaces. It can be advantageous to have at least two independent liquid metal treatment lines (filtration and degassing ladles), to facilitate a sudden transition between the alloys.

The embodiments based on the addition of wire have the disadvantage that a very advanced process control is required. One critical parameter is temperature control, since melting of a metal wire consumes energy, thereby cooling the already liquid metal. For example, it is found that the addition of cold zinc wire to a liquid aluminum bath at a temperature of 720° C. causes a drop in the liquid metal temperature of about 15° C. for a mass flow of about 2.8 kg/s. According to observations made by Applicants, this temperature drop can be compensated by a rapid increase in the temperature of the holding furnace when the liquidus temperature of alloy T is lower than that of alloy P.

Another disadvantage of embodiments based on the addition of wire is that the amplitude of the variation in the chemical composition between alloy P, alloy T and any other alloys is limited by the rate of dissolution of wire in the liquid metal. This problem can be at least partially solved by preheating the wire before adding it into the liquid metal. This preheating can be done using an inerted and heated tube immersed in the liquid metal that unwinds the wire and disperses it in the liquid metal. Such a device was described in patent application EP 819 772 A1 (Alusuisse). The Applicants have found that this device can be used in such a way that the wire is almost in the liquid state when it enters the liquid metal.

Another disadvantage of embodiments based on the addition of wire becomes clear when the composition of the base alloy is very different from the composition of alloys with composition P, T or others: a long length of wire needs to be unwound at a fairly high unwinding rate, or several wire unwinding devices need to be used, which is not always easy.

One advantage of embodiments based on the insertion of wire is that it enables good flexibility for the transition between the two alloys: a sudden transition can be obtained, but in particular this transition can be spread more easily over the length of the slab or billet to obtain a gradual transition. This assumes that the advance rate of the wire or wires (if several wires with the same composition or a different compositions are used) and/or the number of added wires can be varied.

A liquid metal treatment ladle (for example containing an $Ar-Cl_2$ mix) of a known type and/or a gravel type filter ladle, a slab type filter or any other appropriate filtration method can advantageously be used in all these three embodiments so as to minimize the hydrogen content of the liquid metal and to obtain a satisfactory inclusion quality. The transition between alloys advantageously takes place on the output side of the treatment ladles, if it is required to achieve a sudden transition.

In a fourth embodiment, a large liquid metal treatment ladle is used as a reservoir of alloy P to produce alloy T. This embodiment has the advantage that it does not require an additional furnace not required with normally used casting modes. On the other hand, the quantity of metal available for casting the alloy T is limited to the volume of the ladle.

These four embodiments, which can easily be combined with each other, are used to produce a first solid intermediate product intended to be rolled, forged or extruded, and particularly a rolling ingot or a billet with a composition that varies along the casting direction. The cross-section of this first intermediate product is preferably constant over at least 95% of its length.

This first intermediate product, for example a rolling ingot or a billet, thus produced has to be worked in one or several steps, typically while hot, possibly followed by one or several cold working steps, so as to obtain a second intermediate product, such as a plate, an extruded section or bar or a forged product.

Figure 4:
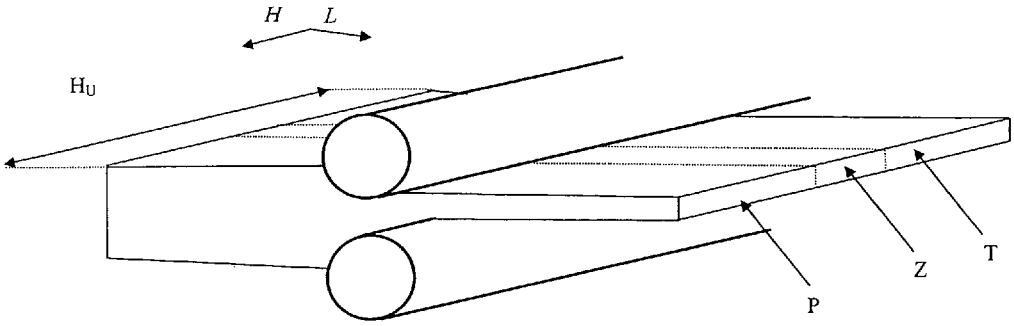
FIG. 4 diagrammatically shows a rolling pass in the direction perpendicular to the length of the slab.

The billets can be used to extrude sections or bars with a variable composition along their length, or as forging blanks. Slabs can be used as forging blanks or rolling ingots. The problem of fabricating rolled products with mechanical characteristics variable in space may be solved using a rolling ingot according to the invention and rolling it to obtain a plate. Rolling along the direction of the length (in other words along the casting direction H) leads to extending the transition zone Z that can be advantageous in some applications. In one embodiment, at least one rolling pass is carried out in the casting direction. However, rolling in the direction of the width (in other words perpendicular to the direction of casting H) is generally preferred, since this avoids extending the transition zone. This induces constraints in the choice of slab dimensions to obtain the required plate dimension. FIG. 4 illustrates rolling of a slab according to the invention along the direction of the width. The rolling direction L is perpendicular to the casting direction H.

Thick plates can thus be made for use in the fabrication of spars with a variable composition, in which one end compatible with an upper wing skin function is oriented towards the upper end of the wing and is designed particularly for compression, while the other end compatible with the lower wing skin function is oriented towards the lower part of the wing and is designed particularly for toughness. For this application, it is preferable to have the shortest possible transition between the two alloys in the cast rolling ingot.

Such a product can be used as a structural element in aeronautical construction. More particularly, such products can be used as spars, ribs or wing skins.

Figure 5:
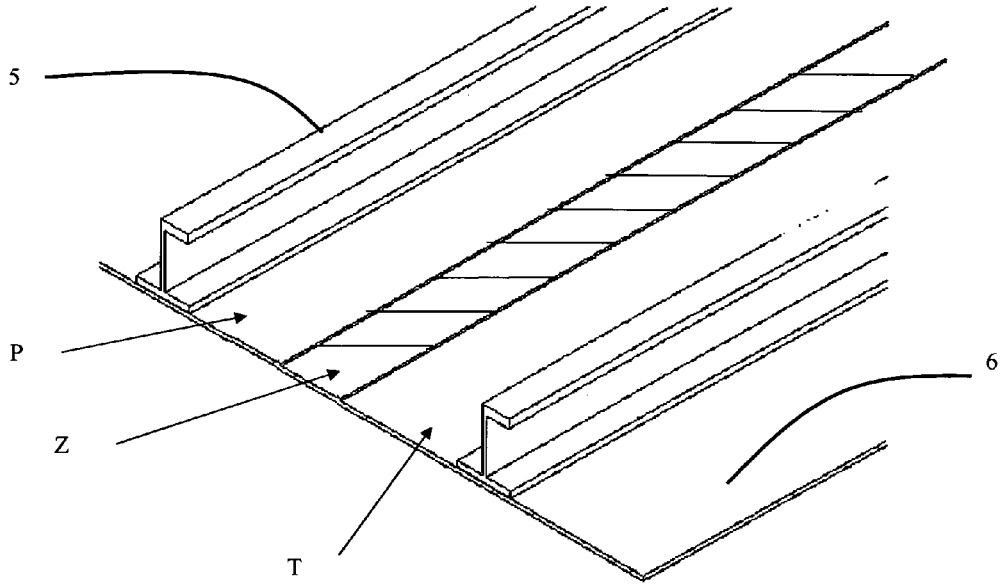
FIG. 5 diagrammatically shows a fuselage panel according to the invention obtained by cross-rolling.

It can also be advantageous to use the invention to make fuselage plates with variable properties, adapted to stresses in the upper and lower parts of the fuselage. For this application, it can advantageously be chosen to roll partly or entirely in the direction perpendicular to the casting direction, which is along the direction of the width of the as-cast slab (FIG. 5).

The invention may be applicable to all aluminum alloys, and advantageously to age hardened alloys from the 2XXX, 6XXX, 7XXX or 8XXX families. In one preferred embodiment, all the alloys used are from the 7XXX family. In another preferred embodiment, all the alloys used are from the 2XXX family and/or are aluminum-lithium alloys (alloys that contain at least 0.1 wt % Li and preferably 0.5 wt % Li). As an example, couples of alloys P and T (or inversely) can be 7040 and 7449 or 2024A and 2027 or 2050 and 2195. In the case of a sequence with composition P/T/[third alloy], 7475 is used in preference for P, 7040 is used in preference for T, and 7449 is used in preference for the third alloy.

A 7XXX alloy containing 4.1 to 5.1% of Zn, 1.5 to 2.5% by weight of Cu and 1.2 to 1.8% by weight of Mg is found to be particularly advantageous in the framework of the invention. This alloy can reach very high toughness by minimizing the loss of static mechanical characteristics compared with an alloy such as the 7040. In one advantageous embodiment of the invention, alloy P is an alloy comprising 4.1 to 5.1% of Zn, 1.5 to 2.5% by weight of Cu and 1.2 to 1.8% by weight of Mg, and alloy T is an alloy comprising 7 to 10% of Zn, 1.0 to 3.0% by weight of Cu and 1.0 to 3.0% by weight of Mg. Combination of 7040 and 7449 alloys is particularly useful for spar applications whereas combination of 7475 and 7449 is particularly useful for wing skin applications.

Processes according to this invention can be used to produce monolithic bi-functional or multi-functional structural elements.

In particular, processes according to this invention can be used to produce structural elements appropriate for use in aeronautical construction comprising spars or ribs for large capacity aircraft wings. FIG. 1 diagrammatically shows a bi-functional spar according to the invention. In such spars, height $H_L$ can reach 1,000 mm or more, length L can be as much as ten meters or more, and thickness E is typically of the order of 100 mm, but may be more. They are made by machining thick plates, and can comprise a bottom flange (4), a top flange (1), a web (2) and stiffeners machined in the mass (3).

Figure 2:
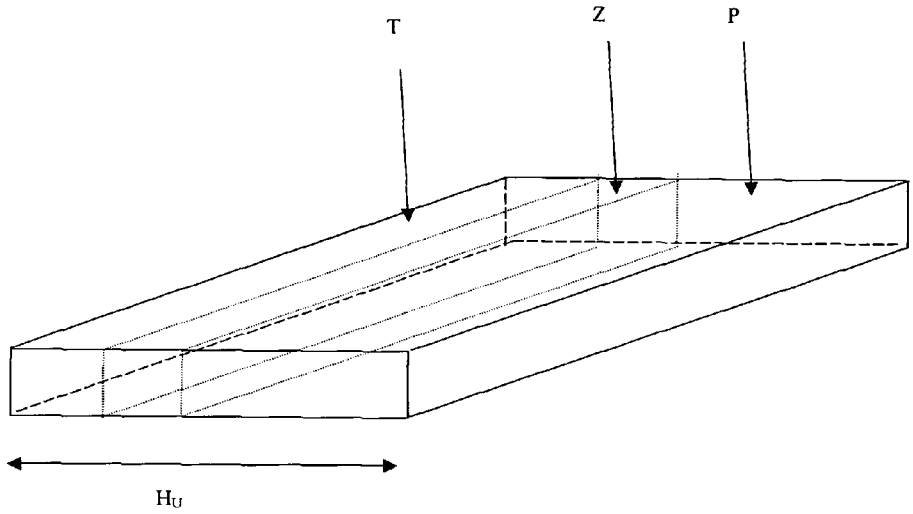
FIG. 2 diagrammatically shows a plate according to the invention, from which the spar according to the invention can be fabricated.

The transition zone Z can be positioned at an equal distance from the flanges or closer to one or the other, depending on the design needs. FIG. 2 diagrammatically shows the thick plate from which these spars were machined. In one advantageous embodiment of the invention, the thick plate was obtained by rolling along the direction of the width of the slab according to the invention, such that the height $H_L$ is slightly less than $H_U$. Rolling in the transverse direction is illustrated in FIG. 4.

Processes according to this invention can also be used to produce structural elements appropriate for use in aeronautical construction comprising fuselage elements. FIG. 5 diagrammatically illustrates the use of a plate according to the invention to make a fuselage panel (6), reinforced by riveted, adhesively bonded or welded stiffeners (5). The two alloys used, P and T, are schematically indicated along with transition zone Z. Other structural elements appropriate for use in aeronautical construction can also be made, starting from intermediate products according to the invention, for example comprising a wing stiffener or a wing panel suitable for use in aeronautical construction.

For a slab, the transformation procedure used that may include homogenization, hot rolling, cold rolling, solution heat treatment, quenching, cold working (such as stretching) and artificial aging steps must be compatible with the alloys in the slab according to the invention. This condition may be restrictive in terms of the choice of alloys since optimum temperatures are sometimes very different for the different alloys and a compromise temperature may not give the required properties. One skilled in the art tries to adapt the transformation sequence to the alloys present in the slab. Similar problems will arise for the skilled person with respect to extrusion billets or forging blanks transformation schedules.

In another embodiment of this invention, the rolling ingot is rolled mainly or exclusively along the direction of its length, that is, in the casting direction. The result is thus long slabs for which one of the geometric ends is made of an alloy with the P composition, and the other geometric end is an alloy with the T composition. These plates have a gradient in their mechanical properties along the direction of their length. This embodiment is particularly useful for wing skin manufacture.

The following non-limiting examples illustrate advantageous embodiments of the invention as an illustration.

EXAMPLES

Example 1

In this example, a rolling ingot was cast such that the bottom (mark P) is made of an Al–Zn 5%–Cu 1.8%–Mg 1.5% alloy and the top (mark T) is made of an Al–Zn 8%–Cu 1.8%–Mg 1.9% alloy. The two alloys were made in two separate furnaces. Table 1 indicates the composition of the two alloys measured on pins obtained by solidification of liquid metal drawn off in both furnaces.

TABLE 1

| | Measured compositions (% by weight) | | | | | | |
|---|---|---|---|---|---|---|---|
| Reference | Zn | Cu | Mg | Si | Fe | Ti | Zr |
| A(P) | 4.93 | 1.83 | 1.48 | 0.033 | 0.053 | 0.0175 | 0.11 |
| A(T) | 8.05 | 1.85 | 1.89 | 0.030 | 0.044 | 0.0202 | 0.12 |

The two liquid alloys were treated with an Ar–$Cl_2$ mix in an IRMA® type treatment ladle for 90 minutes. The transition between alloys was made in a transfer trough. Liquid metal was drawn off in the transfer trough to make spectrometric samples before, during and after transition of the composition every 50 mm of drop. It was thus found that the transition of the composition takes place over a drop height of about 200 mm. The height $H_P$ was 2100 mm, the height $H_T$ was about 1600 mm and the total height of the slab $H_F$ was about 3700 mm. A bottom length $H_{EP}$ of 750 mm and a top length $H_{ET}$ of 300 mm were cropped, which leaves a useable length $H_U$ of about 2600 mm.

Example 2

A slab was cast as described in example 1. The alloy compositions are given in table 2.

TABLE 2

| | Measured compositions (% by weight) | | | | | | |
|---|---|---|---|---|---|---|---|
| Reference | Zn | Cu | Mg | Si | Fe | Ti | Zr |
| B(P) | 4.81 | 1.80 | 1.47 | 0.035 | 0.043 | 0.0184 | 0.11 |
| B(T) | 8.11 | 1.87 | 1.92 | 0.031 | 0.044 | 0.0190 | 0.11 |

The two liquid alloys were treated with an Ar–$Cl_2$ mix in an ALPUR® type treatment ladle. The metal with composition T was prepared from the metal with composition P in an ALPUR® treatment ladle, and the treatment ladle was then supplied with liquid metal from the second furnace, so as to obtain a sudden transition. Liquid metal was drawn off in the transfer trough to make spectrometric samples before, during and after transition of the composition every about 50 mm of drop.

Figure 6:
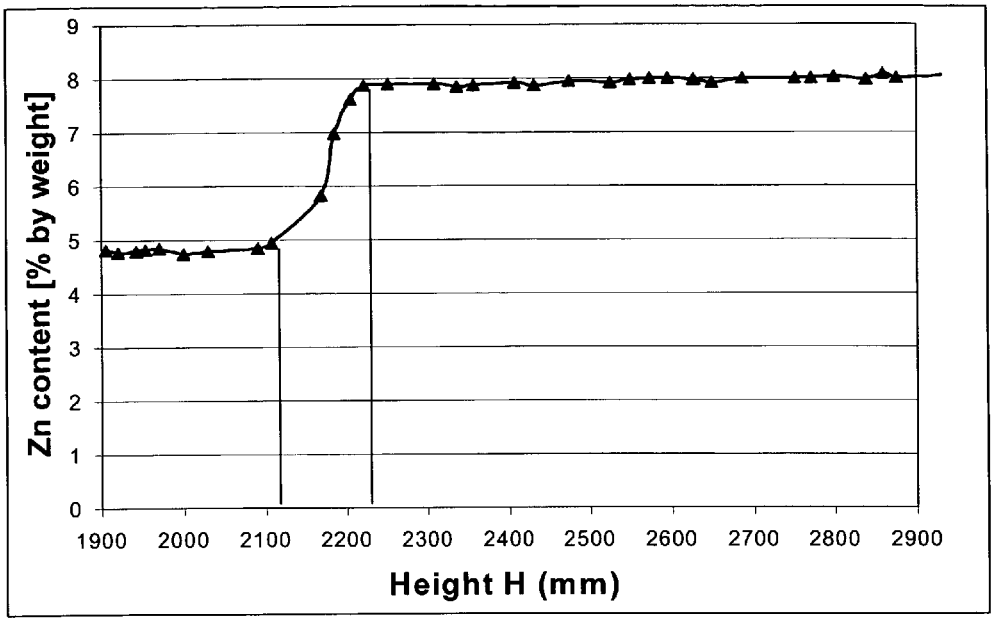
FIG. 6 shows the variation of Zn content during casting according to the invention.

FIG. 6 illustrates the results obtained. The transition of the composition takes place over a drop height of at least 100 mm. The drop height $H_P$ was 2100 mm. The final height $H_F$ of the slab was about 3850 mm. A bottom length $H_{EP}$ of 800 mm and a top length $H_{ET}$ of 300 mm were cropped, which leaves a useable length $H_U$ of about 2750 mm.

Example 3

This example relates to the fabrication of a plate usable for the manufacture of an aircraft wing spar.

The slab derived in example 2 is used. The height $H_U$ of this slab is about 2750 mm, which is sufficient for a spar about 2000 mm long. The slab is homogenised at 470° C. for 48 hours. It is hot rolled in the transverse direction (i.e. perpendicular to the casting direction H of the slab) to a final thickness of 80 mm. The hot rolling temperature is between 400° C. and 460° C. The plate thus obtained is solution heat treated for 12 hours at 473° C. After quenching, the plate is subjected to controlled stretching with a permanent elongation of about 2%.

Figure 7:
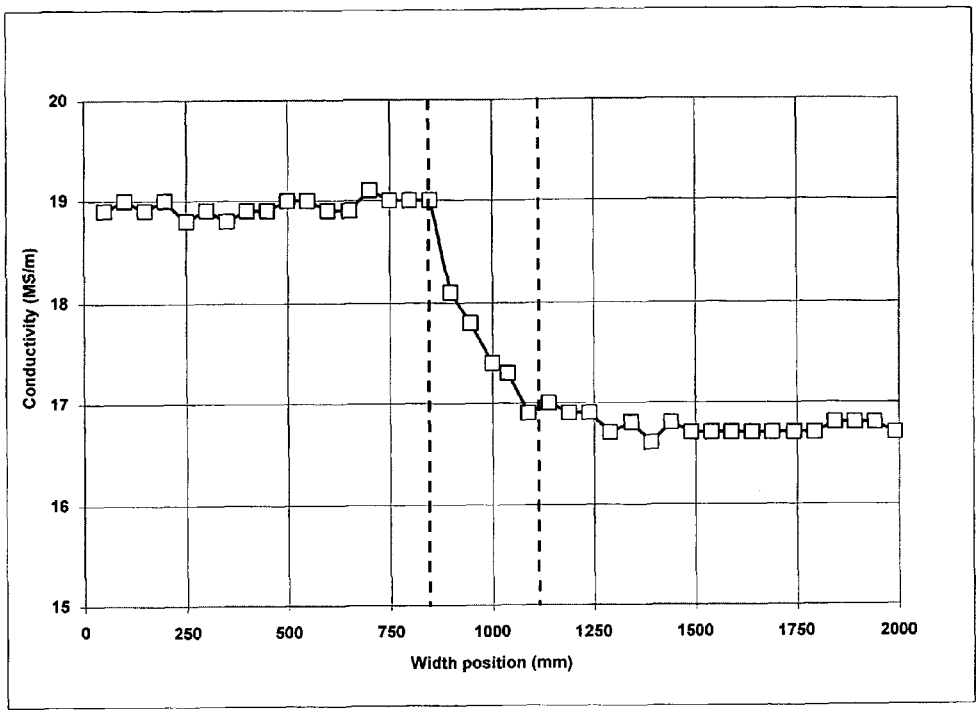
FIG. 7 shows conductivity measurements at mid-thickness for different positions in the width for a cross-rolled plate according to the invention.

The plate obtained is then characterized by a conductivity measurement. FIG. 7 illustrates the conductivity profile obtained at mid-thickness in the casting direction H. The transition zone between alloys extends over a height of about 400 mm. This height is greater than the transition height of 100 mm measured by sampling samples during casting since it includes the shape of the liquid/solid interface which is not a planar surface perpendicular to the casting direction but a surface which shape depends on cooling conditions. A two-step artificial aging is then applied to the plate: 6 hours at 120° C. followed by 20 hours at 155° C. Table 3 below illustrates the static mechanical characteristics, the toughness and resistance to corrosion obtained for samples taken at mid-thickness and quarter thickness.

TABLE 3

| | Quarter thickness L direction | | | Mid-thickness L direction | | | $K_{1C}$ L-T MPa√m | | |
|---|---|---|---|---|---|---|---|---|---|
| | Rm (MPa) | $R_{p0.2}$ (MPa) | A % | Rm (MPa) | $R_{p0.2}$ (MPa) | A % | CT30 t/4 | CT40 t/2 | Exco |
| P | 453 | 418 | 15.6 | 493 | 437 | 12.3 | 56.7 | 66.6 | EA |
| T | 537 | 515 | 12.4 | 575 | 536 | 10.2 | 34 | 42.4 | EA/B |

A plate is obtained with a value of $R_{p0.2}$ greater than 510 MPa and a value of $K_{IC}$ greater than 32 MPa√m at end T, and a value of $R_{p0.2}$ greater than 410 MPa and a value of $K_{IC}$ greater than 54 MPa√m at end P. Bi-functional structural elements for aeronautical construction can be machined from this plate to make spars, so that the upper wing skin side is made of an alloy with composition T and the lower wing skin side is made of an alloy with composition P. This spar is shown diagrammatically in FIG. 1.

Example 4

In this example, a rolling ingot made of aluminum based alloy in which the bottom composition P (alloy type AA 7449) comprises 8% zinc, 1.9% magnesium and 1.8% copper, and the top composition T (AA7040 type alloy) comprises 5% zinc, 1.5% magnesium and 1.8% copper is cast. The zirconium content is 0.11%. This slab is cast by preparing an alloy with composition P, treating the metal by a gas ($Ar+Cl_2$) in a treatment ladle, casting the slab up to the required $H_P$ equal to half of the final height $H_F$ of the finished slab using alloy with composition P, and casting is then continued up the a final height $H_F$ using an alloy obtained by adding the required quantity of zinc and magnesium rich metal to change the composition from P to T. This added solid metal is made by using an unwinder to unwind two wires with appropriate zinc and magnesium contents, supplied in coils.

Example 5

In this example, a rolling ingot made of aluminum alloys was cast such that the bottom (P) comprised 1.8 wt % Mg, 7.8 wt % Zn and 1.8 wt % Cu and the top part (T) comprised 1.3 wt % Mg, 7.8 wt % Zn and 1.8 wt % Cu. The zirconium content was 0.10 wt %. In order to cast this plate, an alloy with composition T was prepared and the needed quantity of Mg to reach composition P was added in a treatment ladle. The transition between the two composition was progressive, composition T was reached for 800 mm drop height. The ingot is then homogenized, hot rolled to a 100 mm gauge, solution treated, quenched and aged. Results obtained for bottom and top are presented in Table 4.

TABLE 4

| Aging | | ¼ thickness L direction | | | $K_{1C}$ L-T MPa√m |
|---|---|---|---|---|---|
| conditions | Mark | Rm (MPa) | $R_{p0.2}$ (MPa) | A % | CT40 t/4 |
| 15 h 155° C. | P | 518 | 504 | 10.4 | 38.9 |
| 15 h 155° C. | T | 490 | 469 | 12.2 | 44.6 |

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

As used herein and in the following claims, articles such as "the", "a" and "an" can connote the singular or plural. In the present description and in the following claims, to the extent a numerical value is enumerated, such value is intended to refer to the exact value and values close to that value that would amount to an insubstantial change from the listed value.

What is claimed is:

1. A vertical casting process for an intermediate product having final drop height $H_F$ in a casting direction H, comprising the steps of:

(a) preparing at least two aluminum based alloys, a first alloy with composition P and a second alloy with composition T, (b) casting the first alloy with composition P to a required height $H_P$ in the casting direction, and (c) subsequently, casting the second alloy of composition T from an upper surface of the cast first alloy at height $H_P$ to an additional required height $H_T$ in the casting direction, so as to obtain a casting height in the casting direction of $H_P+H_T$ that is equal to $H_F$ or less than $H_F$, producing thereby a cast intermediate product having a transition zone Z between the first and second alloys, the transition zone Z having a composition intermediate between the first and second alloys.

2. A process according to claim 1, wherein said aluminum based alloys P and T are prepared independently.

3. A process according to claim 1, wherein said aluminum based alloy T is prepared by adding further elements to alloy P to obtain alloy T.

4. A process according to claim 1, wherein said aluminum based alloys P and T are prepared from a base alloy by adding further elements to the base alloy to obtain the at least one of the alloys P and T.

5. A process according to claim 1, wherein a transition between alloys P and T is obtained with no interruption to liquid metal flow.

6. A process according to claim 1, wherein $H_P+H_T$ is equal to $H_F$.

7. A process according to claim 6, wherein alloy P is alloy 7040 and alloy T is alloy 7449.

8. A process according to claim 6, wherein alloy P comprises 4.1 to 5.1% by weight of Zn, 1.5 to 2.5% by weight of Cu and 1.2 to 1.8% by weight of Mg, and alloy T comprises 7 to 10% by weight of Zn, 1.0 to 3.0% by weight of Cu and 1.0 to 3.0% by weight of Mg.

9. A process according to claim 1, wherein $H_P+H_T$ is less than $H_F$, additionally comprising casting alloy P from height $H_P+H_T$ to height $H_F$.

10. A process according to claim 1, wherein $H_P+H_T$ is less than $H_F$, additionally comprising preparing at least one further alloy and casting said at least one further alloy from height $H_P+H_T$ to height $H_F$.

11. A process according to claim 10, wherein alloy P is alloy 7475, alloy T is alloy 7040, and said at least one further alloy is alloy 7449.

12. A process according to claim 1, additionally comprising cropping the cast intermediate product at a bottom thereof at a height $H_{EP}$, wherein height $H_P$ is greater than or equal to height $H_{EP}$.

13. A process according to claim 12, wherein height $H_P$ is greater than or equal to $H_{EP}+H_U/4$, where $H_U$ is useful length of the cast, intermediate product.

14. A process according to claim 1, wherein the aluminum alloys are age hardened alloys selected from the group consisting of alloys 2XXX, 6XXX, 7XXX and 8XXX.

15. A process according to claim 1, wherein the aluminum alloys are 7XXX alloys.

16. A process according to claim 1, wherein the aluminum alloys are 2XXX alloys.

17. A process according to claim 1, wherein the aluminum alloys are aluminum-lithium alloys.

* * * * *